US006009730A

United States Patent [19]

Lee

[11] Patent Number: 6,009,730

[45] Date of Patent: Jan. 4, 2000

[54] DAMPER ASSEMBLY IN WASHING MACHINE

[75] Inventor: Jae-Min Lee, Kyungsangnam-do, Rep. of Korea

[73] Assignee: L G Electronics, Inc., Seoul, Rep. of Korea

[21] Appl. No.: 08/971,336

[22] Filed: Nov. 17, 1997

[30] Foreign Application Priority Data

May 20, 1997 [KR] Rep. of Korea ..... 97-11260
May 20, 1997 [KR] Rep. of Korea ..... 97-11261
May 20, 1997 [KR] Rep. of Korea ..... 97-11262

[51] Int. Cl.[7] ..... D06F 37/24

[52] U.S. Cl. ..... 68/23.3; 68/23.1

[58] Field of Search ..... 68/23.1, 23.3; 188/129, 381; 248/638, 610, 562; 267/141, 196, 134, 135, 140.11, 140.3

[56] References Cited

U.S. PATENT DOCUMENTS 2,982,510 5/1961 Curriston ..... 248/358
4,533,216 8/1985 Mueller ..... 267/141
5,520,029 5/1996 Savkar ..... 68/23.3
5,528,913 6/1996 Savkar ..... 68/23.3
5,606,879 3/1997 Froelicher ..... 68/23.3

FOREIGN PATENT DOCUMENTS 2092396 3/1990 Japan ..... 68/23.3

*Primary Examiner*—Frankie L. Stinson
*Attorney, Agent, or Firm*—Fish & Richardson PC

[57] ABSTRACT

A damper assembly for a washing machine includes a snubber bar, a damper cap, a snubber base, and a snubber base spring. The snubber bar has an upper portion supported at a corner of a washing machine body. The damper cap supports a lower portion of the snubber bar. The snubber base is held at a lower end of the snubber bar and is elastically inserted inside the damper cap by a damping spring. The snubber base spring is inserted in an inside circumference of the snubber base to expand the snubber base such that an outside circumference of the snubber base makes close contact with the inside circumference of the damper cap. Furthermore, at least a cut-away portion is formed in a circumferential surface of the snubber base for uniform distribution of an elastic force of the snubber base spring, thus improving contact between the snubber base and the inside circumference of the damper cap.

20 Claims, 9 Drawing Sheets

DAMPER ASSEMBLY IN WASHING MACHINE

BACKGROUND OF THE INVENTION

1. Field of the Invention

The present invention relates to a damper assembly which can attenuate the vibration occurring during washing, and more particularly, to a snubber base which moves up and down in a damper cap of a damper assembly in a washing machine, during which the snubber base makes contact with the damper cap.

2. Discussion of the Related Art

A washing machine, strips off contaminants such as dirt that is stuck on laundry, in general, by means of water circulation formed from the rotational force of a pulsator, and conducts either a washing or rinsing mode by means of pulsatile and rotational circulation of the water in an outside tub. The rotational force is formed by a regular or reverse direction rotating force of a motor. A driving force, is transmitted to the pulsator through a clutch-controlled speed reduction mechanism of clutch to rotate the pulsator. A washing machine also conducts a spin drying mode by means of the centrifugal force produced as the inside tub rotates. In a washing machine that uses water circulation strength or form to wash the laundry, the washing is carried out by stripping contaminants off the laundry with a combination of the mechanical actions of water shearing force, the bending and, stretching of the laundry, the friction exerted by and on the laundry, and chemical action of detergent.

FIG. 1 illustrates a cross sectional view of a conventional washing machine, including an outside tub 2 in a body 1 of the washing machine supported by a plurality of damper assembly 3, an inside tub 4 rotatably mounted in the outside tub for accommodating laundry (not shown), and a pulsator 5 rotatably mounted on a bottom of the inside tub 4 at a center thereof for generating a pulsatile circulation. The pulsator 5 is fixed to a shaft 7 rotated by a motor 6. A and there is a clutch under the shaft can be engaged to selectively rotate either the inside tub 4 or the pulsator 5. The rotational force generated by the motor is transmitted thereto through a timing belt 8. A water supplying device at the top of the body 1 selectively supplies, depending on selection of a water supplying mode of a user, either cold water and hot water simultaneously or cold water or hot water selectively, into the outside tub A detergent box 11 is located at an outlet in the water supplying device for automatic introduction of detergent into the outside tub 2 with the initial water supply when a washing mode is set A drain valve 12 is located at a lower portion of the outside tub for draining waste water after completion of washing.

Accordingly, after opening a door 13 on top of the body 1, and introducing the laundry into the inside tub 4, opened door 13 is closed and a washing mode is set on the control panel. When operating, the washing, rinsing, and dehydrating cycles are conducted in succession in response to control signals from a controller. Upon setting the washing mode in the controller, after the pulsator 5 is rotated to determine a weight of the laundry to determine a quantity of water to be supplied, the determined quantity of water is supplied into the inside tub 4. The detergent in the detergent box 11 is automatically introduced into the inside tub 4 together with the water supply. Upon completion of supply of the water and detergent into the inside tub 4, power is applied to the motor 6, generating a rotating force, to rotate a motor shaft in regular and reverse directions, intermittently. When the rotating force of the motor is transmitted to the clutch 9 through the timing belt 8 wound between the pulleys 14*a* and 14*b*, as the motor is driven, the clutch 9 rotates the pulsator 5 fixed to the shaft 7 at a reduced speed, to form a pulsatile circulation in the water in the inside tub 4 to circulate the laundry. Thus, washing of the laundry is made by a pulsatile circulation, friction between the inside tub 4 and the laundry and dissolving effect of the detergent. After proceeding through the aforementioned washing cycle for the laundry for a preset time period, drain valve 12 opens in response to a control signal from the controller drain waste water in the inside tub 4 to outside of the body 1. Upon completion of draining the waste water from the inside tub 4, water is supplied to inside tub 4 by an operation identical to the above operation, and pulsator 5 is operated for a preset number of pulses, to conduct the rinse cycle. While the water is supplied for the rinse cycle, no detergent is present in the detergent box 11. After completion of the rinse cycle, the clutch 9 is changed over from the pulsator 5 to the inside tub 4, to rotate a inside tub 4 without reduction in speed while leaving the pulsator 5 stationary in this manner, the washing machine conducts its spin cycle to remove water from the laundry. When the spin cycle is finished, an alarm indicates that the washing is complete and operation of the washing machine is finished.

In the washing machine, described above while in the washing, rinsing and spinning cycles where is a vibration resulting from the to driving of the motor in each of the modes and also from the circulation of the water and the laundry during washing and rinsing. This vibration causes noises during operation of the washing machine. In order to attenuate the vibration produced during operation of the washing machine, the outside tub 2, which has parts such as motor 6 and clutch 9 mounted thereon as shown in FIG. 1, is suspended from body 1 by means of a plurality of damper assemblies 3. The damper assembly 3 gradually attenuates vibration with spring damping, frictional damping from sliding between solid state bodies and air compression damping.

FIG. 2 schematically illustrates a perspective view showing conventional damper assemblies mounted in a washing machine. FIG. 3 illustrates a cross sectional view of the damper assembly shown in FIG. 2.

The damper assembly 3, mounted between the body 1 and the outside tub 2 for absorbing and attenuating the vibration generated during operation of the washing machine, will be explained with reference to FIGS. 2 and 3.

The damper assembly 3 includes an upper corner 15 at every corner inside of the body 1, an upper pivot 16 coupled to each of the upper corners, a snubber bar 17 having one end supported by the upper pivot and the other end hung from the one end, a plurality of supporting members 18 each formed on an outside circumference of the outside tub 2 at a lower side thereof, a damper which receives the other end of the snubber bar and supported by the supporting member 18 for damping the vibration. The damper 19 includes a guide bar 20*a* formed at top of a damper cap 20 as a single unit therewith for guiding up and down movements of the damper cap 20 along the snubber bar 17, a snubber base 21 coupled with the snubber bar at a bottom thereof for making up and down movements while making a close contact with an inside circumference of the damper cap, a damping spring 22 accommodated in the damper cap, inserted in the snubber bar and held in place by the snubber base, and a washer 23 inserted to the snubber bar under a bottom of the snubber base for preventing deformation of rubber of the snubber base during operation.

The aforementioned damper assembly 3 gradually attenuates the vibration generated either from the pulsatile circulation caused by centrifugal force of the pulsator 5 rotation and the laundry gathered to one side as the laundry circulate during washing or rinsing mode, or by inclination of the inside tub 4 and the laundry gathered as the inside tub 4 rotates during a dehydrating mode.

For example, if the laundry is gathered to one side at completion of drainage in the dehydrating mode, the inside tub 4, rotated with an inclination at an initial rotation, generates vibration, which is attenuated by the damper 19 between the body 1 and the outside tub 2. That is, the damper cap 20, supported by the supporting member 18 surrounding an outside circumference of the snubber bar 17 passed through and hung from the upper pivot 16 and having a top thereof connected to the outside tub 2, dampens the vibration as it is compressed and expanded in directions as shown by arrows in FIG. 3.

If the body 1 is away from the outside tub 2 due to the inclination of the inside tub 4, the outside tub 2, guided by the guide bar 20*a* at top of the damper cap 20, moves down along the outside circumference of the snubber bar 17. As the damper cap 20 moves down, the damper cap 20 rubs against an outside circumference of the snubber base 21 which is in close contact with the inside circumference of the damper cap 20 and the air inside of the damper cap 20 is compressed, to attenuate most of the vibration occurring during rotation of the inside tub 4. Moreover, the spring in the damper cap 20 is compressed when the damper cap 20 moves down to dampen the vibration.

If, on the other hand, the body 1 and the outside tub 2 come closer due to the inclination of the inside tub 4, the damper cap 20, guided by the guide bar 20*a* at top of the damper cap 20, moves up along the outside circumference of the snubber bar 17. As the damper cap 20 moves up, the damper cap 20 makes friction with an outside circumference of the snubber base 21 which is in close contact with the inside circumference of the damper cap 20 and the air inside of the damper cap 20 is expanded, to attenuate most of the vibration occurring during rotation of the inside tub 4. Moreover, the spring in the damper cap 20 is extended when the damper cap 20 moves up to dampen the vibration.

Of these vibration absorbing mechanisms of solid state friction damping (i.e., produced from sliding of the inside circumference of the damper cap 20 in contact with the outside circumference of the snubber base 21, air compression damping produced from compression of the air in the damper cap 20, and spring damping produced from compression and extension of the damping spring 221, the most important component to the damping is the snubber base 21 that moves up and down inside of the damper cap 20 to compress and extend the damping spring 22. This component to damping is important because the damping coming from friction as well as the damping coming from air compression results only if the outside circumference of the snubber base 21 makes close contact with the inside circumference of the damper cap 20. The part that continuously maintains the damping of the damper 19 effective by causing the outside circumference of the snubber base 21, i.e., the sliding surface to make a close contact with the inside circumference of the damper cap 20 is the snubber base spring 24 inserted in the inside circumference of the snubber base 21. The snubber base spring 24 should be adapted to keep a state in which the snubber base spring 24 is fitted in the snubber base 21 and to apply a force to the snubber base 21 continuously to expand the snubber base 21. To do this, as shown in FIG. 4, there is a recess 21 a formed in the inside circumference of the snubber base 21 which is held at the other end of the snubber bar 17 for making up and down movements in the damper cap 20, for the purpose of inserting the snubber base spring 24 therein. Although in most cases, the snubber base 21 is formed of a rubber, it may be formed of a plastic. When the damper 19 has a rubber snubber base, since it is not self lubricative with a great friction, a coat of fluororesin is applied to the outside circumference of the snubber base 21 to reduce the friction, for smoother sliding movements at a contact surface between the damper cap 20 and the snubber base 21. And, there is a steel washer 23 fixed under the bottom of the snubber base 21 which is held at a lower end of the snubber bar 17 for preventing distortion of the snubber base 21 of a comparatively soft material during operation. However, when the damper 19 has a plastic application snubber base 21, though the application of fluororesin coating to the sliding surface(the outside circumference) is not required because the plastic is self lubricative and no washer is required because rigidity of the plastic is greater than the rubber, an appropriate friction between the inside circumference of the damper cap 20 and the outside circumference of the snubber base 21 will not be provided unless a separate elastic body is not inserted in the inside circumference of the snubber base 21. Because injection molding of the recess 21*a* in the inside circumference of the snubber base 21 for inserting the elastic body, under-cutting the snubber base 21, is not easy to process, the elastic body is not actually provided to the snubber base 21.

Instead either a coil spring 24*a* as shown in FIG. 5A or a tension spring 24*b* as shown in FIG. 5B is used as a substitute for the snubber base spring 24 and expand the snubber base 21 so that the snubber base 21 can make close contact with the inside circumference of the damper cap 20. However, as the coil spring 24*a* has a smaller elastic force that is not enough to cause the outside circumference of the snubber base 21 to make a close contact with the inside circumference of the damper cap 20, the tension spring 24*b* is used in most of the cases. Both ends of the tension spring are bent inwardly for easy of assembly and preventing tearing of the snubber base 21 of rubber.

However, the aforementioned conventional damper assembly has the following problems.

First, if tension spring 24*b* is use as the snubber base spring 24, because there is no means for preventing the tension spring 24*b* from moving in a direction of the arrow shown in FIG. 4 along the recess 21*a* formed in the inside circumference of the snubber base 21 during the up and down movements of the snubber base 21 inside of the damper cap 20, it is frequently observed that the tension spring 24*b* comes off out of its position, resulting in degradation of the solid state friction damping coming from the sliding friction because the outside circumference of the snubber base can not make a close contact with the inside circumference of the damper cap 20 during the up and down movements of the snubber base 21. If coil spring 24*a* is applied as the snubber base spring 24, and the spring does not have enough force to expand the snubber base 21, the space inside of the damper cap 20 will be insufficiently can be hardly sealed and there may insufficient friction at the contact surface between the damper cap 20 and the snubber base 21.

Second, there can be a distortion of the snubber base 21 caused by the temperature rise resulting from the friction between the damper cay 20 and the snubber base 21 during vibrations. The distortion causes the seal to break between the inside circumference of the damper cap 20 and the snubber base 21 of vibration by the friction and sealing is minimal. Furthermore, as the fluroresin applied to the sliding surface 21*b* wears down the friction caused by the direct contact of the rubber outside circumference of snubber base 21 with the inside surface of the damper cap 20, causes the lower lip of the snubber base 21 to turn inside out. In other words, the strong friction at the direct contact of the rubber, which has a greater friction than the fluororesin, with the inside circumference of the damper cap when the damper cap 20 moves down causes the lip of the snubber base 21 to turn inside out. This inversion of the lip results in the snubber base spring coming out of the recess 21*a* and causes the aforementioned problem namely, breaking the seal between damper cap 20 and snubber hase 21.

Third, if due to a severe vibration the snubber base 21 comes out of the damper cap 20, through the bottom opening of the damper cap 20 snubber base spring 24 may fall out of the snubber base. The soft rubber of snubber base 21 is expanded by the elastic force of the snubber base spring 24 to a diameter greater than the inside diameter of the damper cap 20. Thus, if snubber base spring 24 hits the bottom of the damper cap 20 at rise of the snubber base 21, the spring may fall out of the snubber base and cause the aforementioned problem.

Fourth, under certain circumstances can extend the lower end of the snubber bar 17, beyond the bottom of the snubber base and hit the steel washer 23 which generates noise or, if the snubber base 21 is plastic, in which case no steel washer is inserted in the snubber base 21 due to the rigidity of plastic, the plastic snubber base may break when the snubber bar hits the snubber base 21 due to the incapability of pushing down of the snubber base 21 during the upward movement of the damper cap 20 coming from degradation of the elastic force of the damping spring 22 after repeated vibration absorption action. This leads to an impact on the bottom of the snubber base 21 when the damper cap 20 moves down again, which causes the lower end of the snubber bar 17 to hit the steel washer or plastic snubber base.

SUMMARY OF THE INVENTION

Accordingly, the present invention is directed to a damper assembly in a washing machine that substantially obviates one or more of the problems resulting from the limitations and disadvantages of the related art.

An object of the present invention is to provide a damper assembly in a washing machine which can prevent the snubber base spring therein from falling out of the snubber base and the snubber base from being distorted to maintain effective damping by the damper.

Another object of the present invention is to provide a damper assembly in a washing machine that can reduce vibration and noise of a washing machine and prevent breakage of a snubber base.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the damper assembly in a damping system comprises a plurality of snubber bars each having an upper portion supported at a corner of a washing machine body, a damper cap coupled to an outside surface of an outside tub for supporting a lower portion of each of the snubber bars, a snubber base held at a lower end of each of the snubber bars and elastically inserted inside of each of the damper caps by a damping spring for making up and down movements while making a close contact with an inside circumference of the damper cap, and a snubber base spring inserted in an inside circumference of the snubber base for expanding the snubber base so that an outside circumference of the snubber base makes a close contact with the inside circumference of the damper cap, the damper assembly includes spring holding means having upper projections and lower projections formed on the inside circumference of the snubber base for keeping the snubber base spring in position, and at least a cut-away portion formed in a circumferential surface of the snubber base for uniform distribution of an elastic force of the snubber base spring so that the close contact of the snubber base with the inside circumference of the damper cap can be improved.

Further, there is stopper means formed inside of the snubber base for preventing rotation of the snubber base spring during the up and down movements of the snubber base. The stopper means may preferably be formed at a position located away from the cut-away portion.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Reference will now be made in detail to the preferred embodiments of the present invention, examples of which are illustrated in the accompanying drawings. The present invention is applicable to a damper assembly 3 using a snubber base 21 formed of a plastic and a tension spring 24*b* as a snubber base spring 24.

Figure 1:
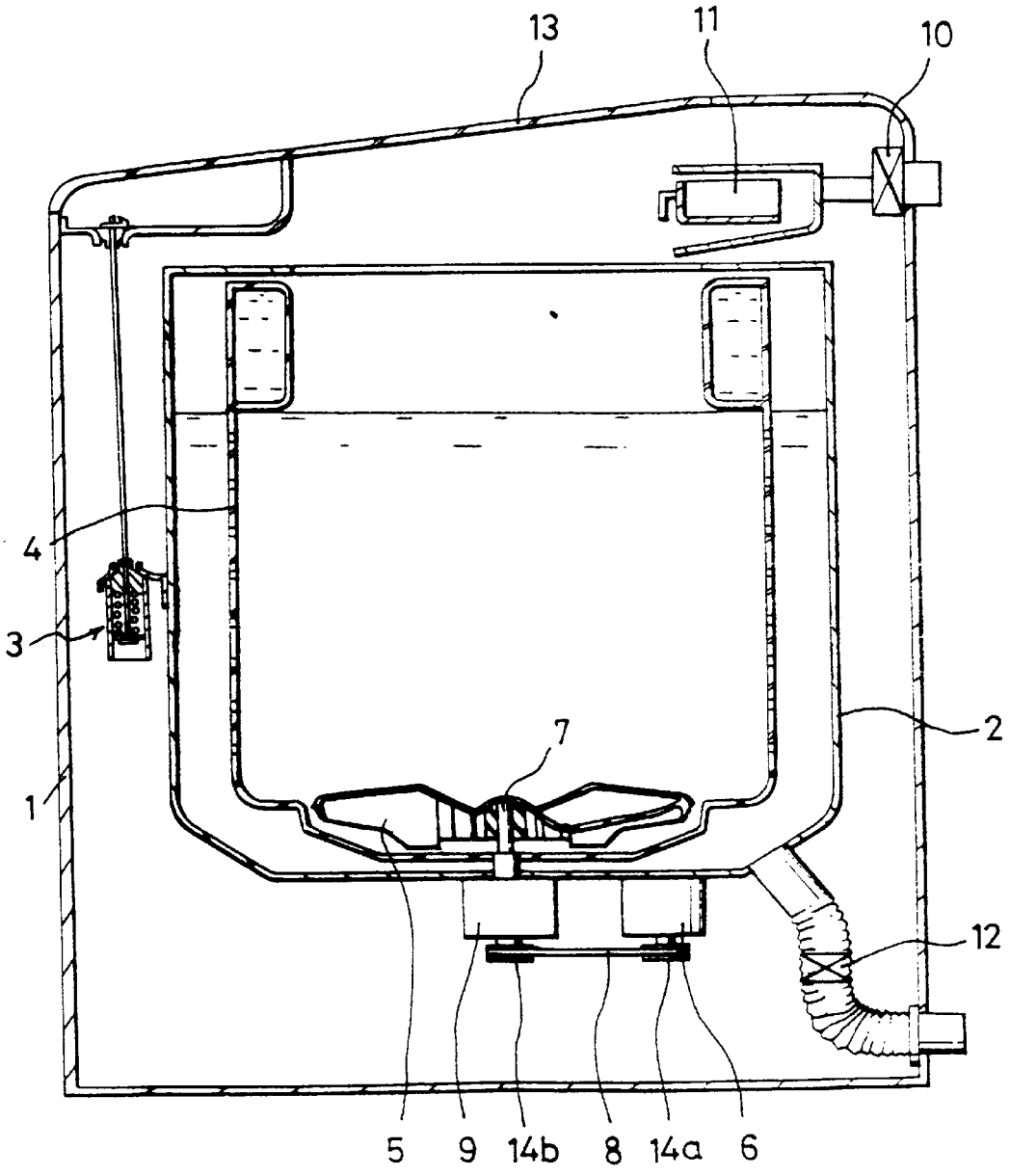
FIG. 1 Prior Art
FIG. 1 illustrates a cross sectional view of a conventional washing machine.
Figure 2:
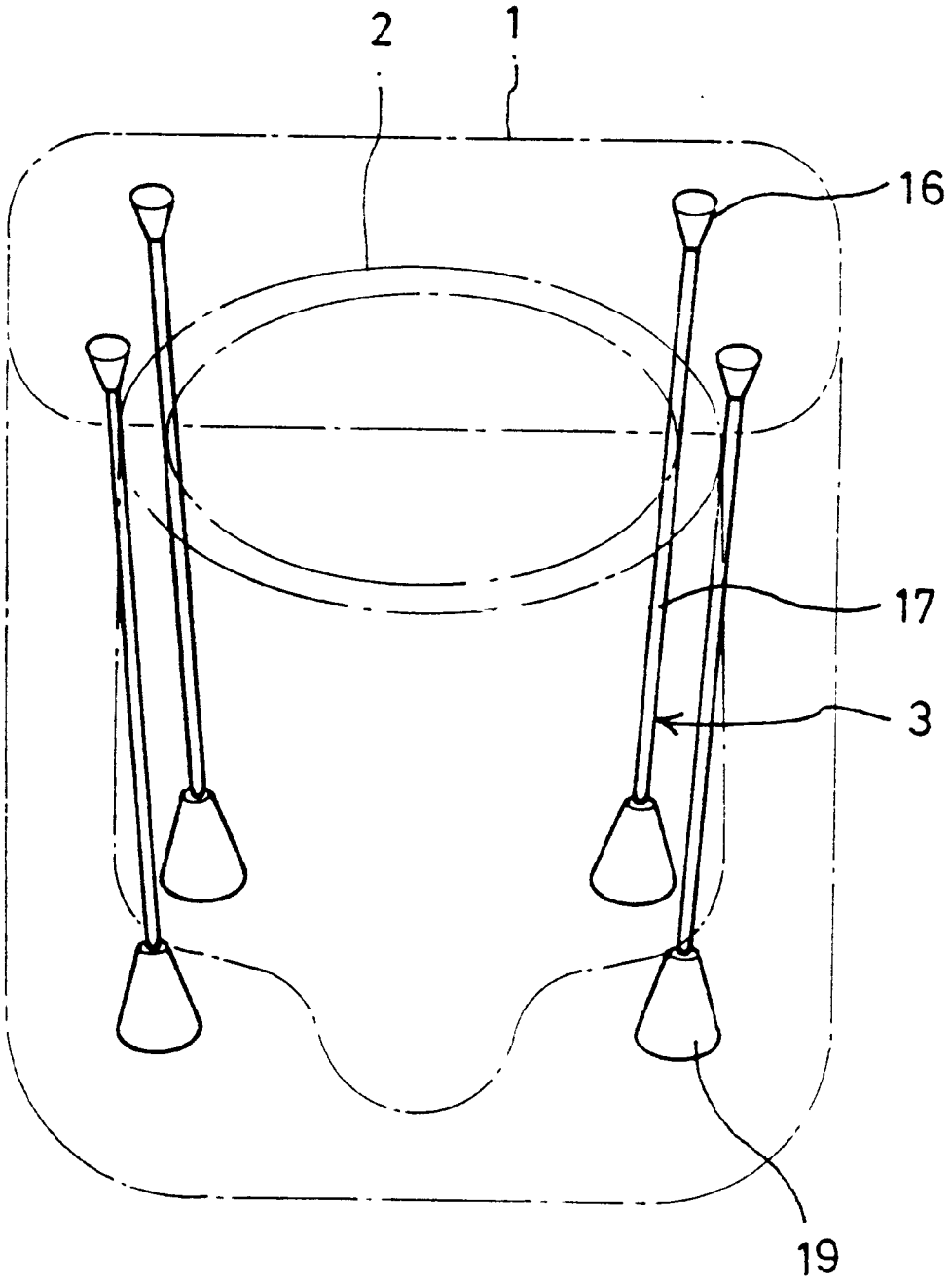
FIG. 2 Prior Art
FIG. 2 schematically illustrates a perspective view showing conventional damper assemblies mounted in a washing machine.
Figure 3:
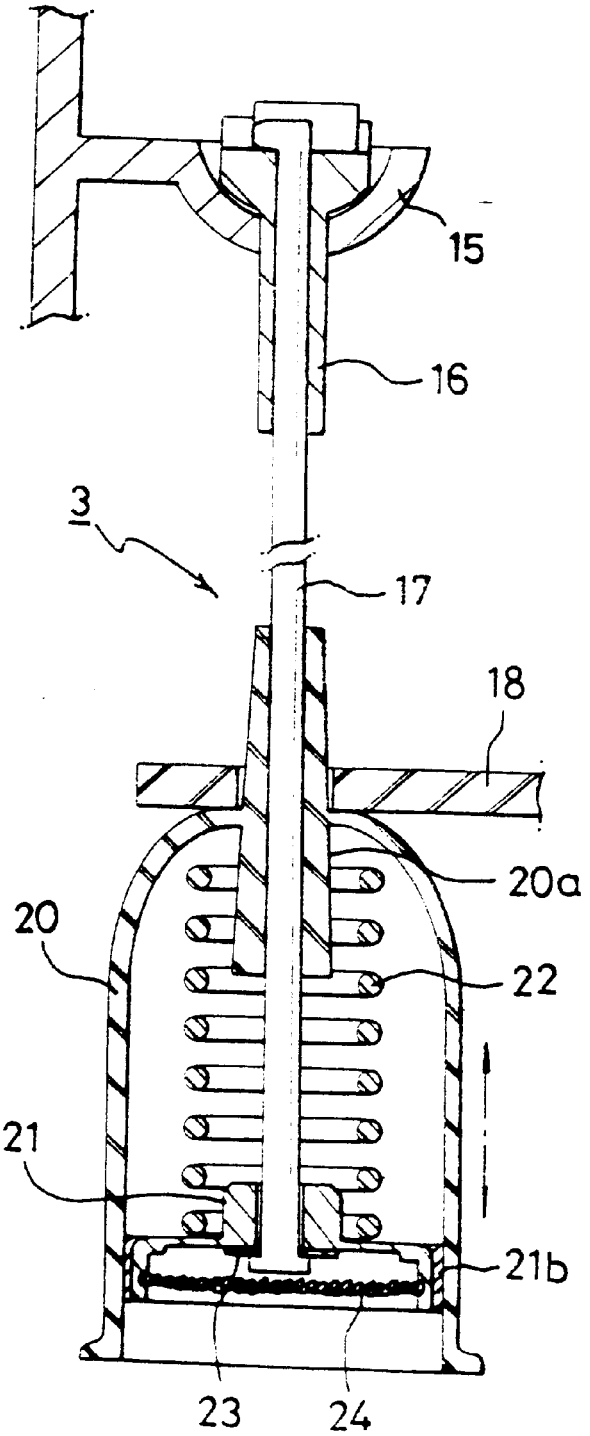
FIG. 3 Prior Art
FIG. 3 illustrates a cross sectional view of the damper assembly shown in FIG. 2 as mounted.
Figure 4:
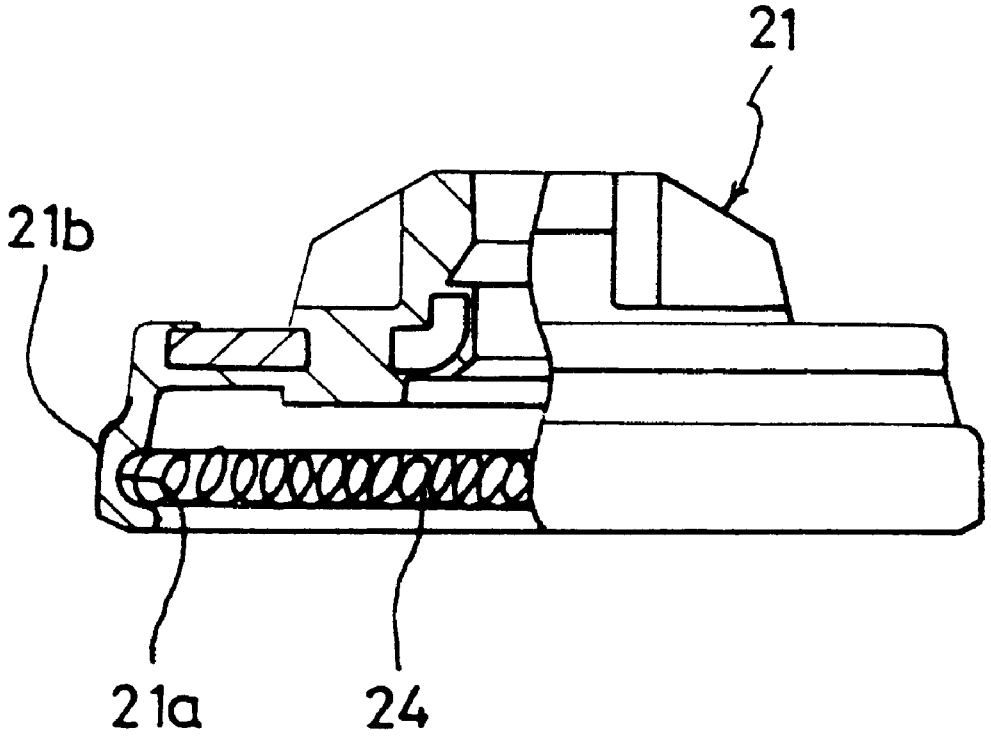
FIG. 4 Prior Art
FIG. 4 illustrates a front view of a conventional snubber base with a partial cut-away view.
Figure 5A:
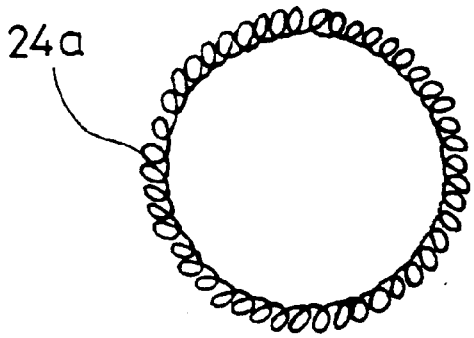
FIG. 5A Prior Art
FIG. 5A illustrates a plane view of a coil type snubber base spring.
Figure 5B:
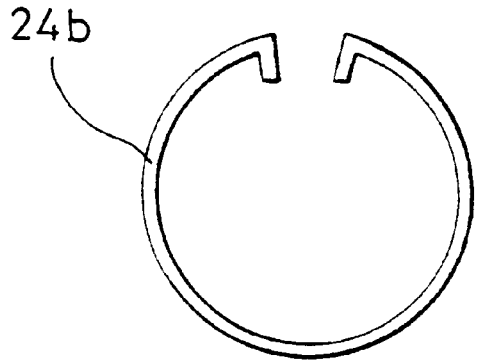
FIG. 5B Prior Art
FIG. 5B illustrates a plane view of a steel wire type snubber base spring.
Figure 6:
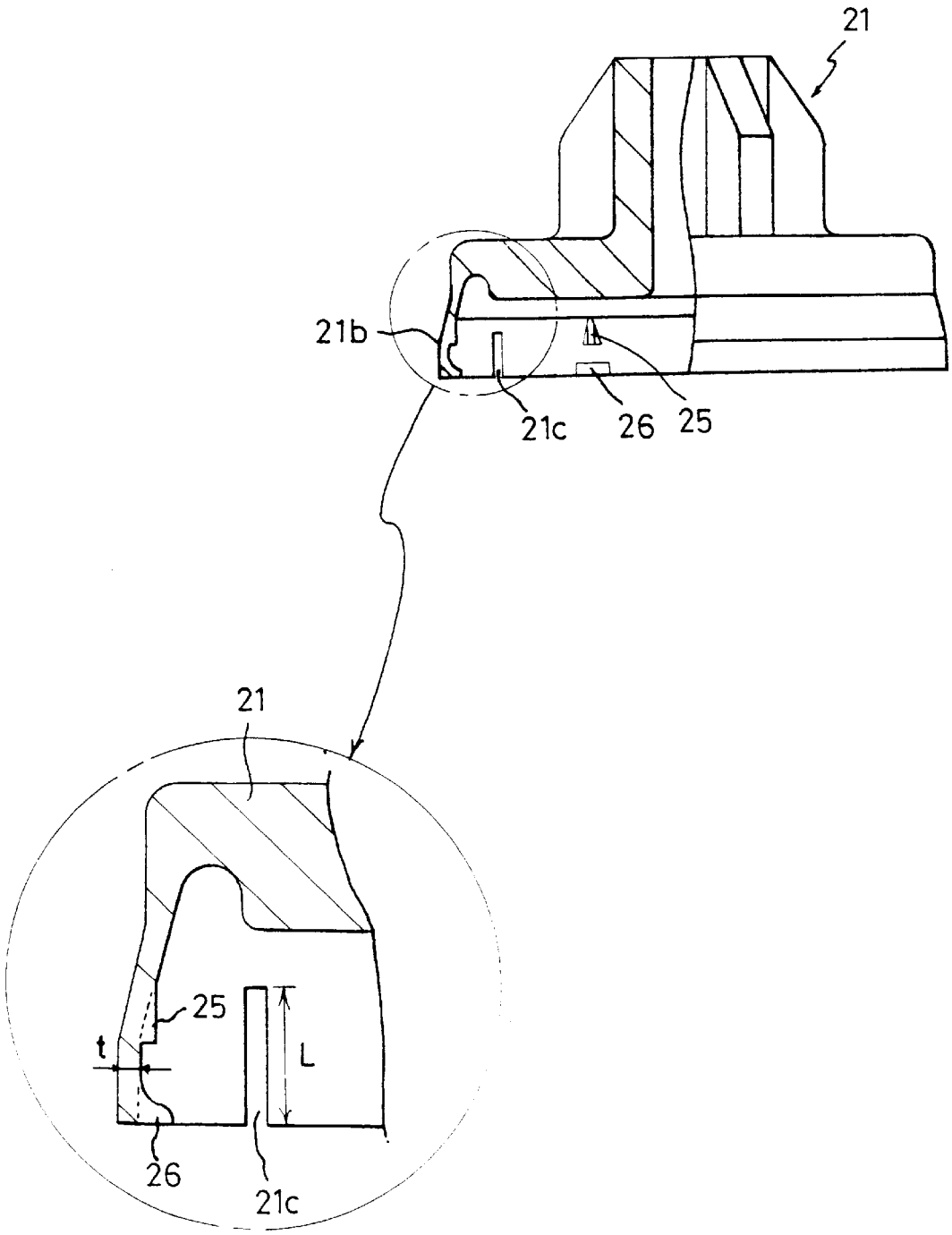
FIG. 6 illustrates a cross sectional view of a snubber base in accordance with a preferred embodiment of the present invention.
Figure 7:
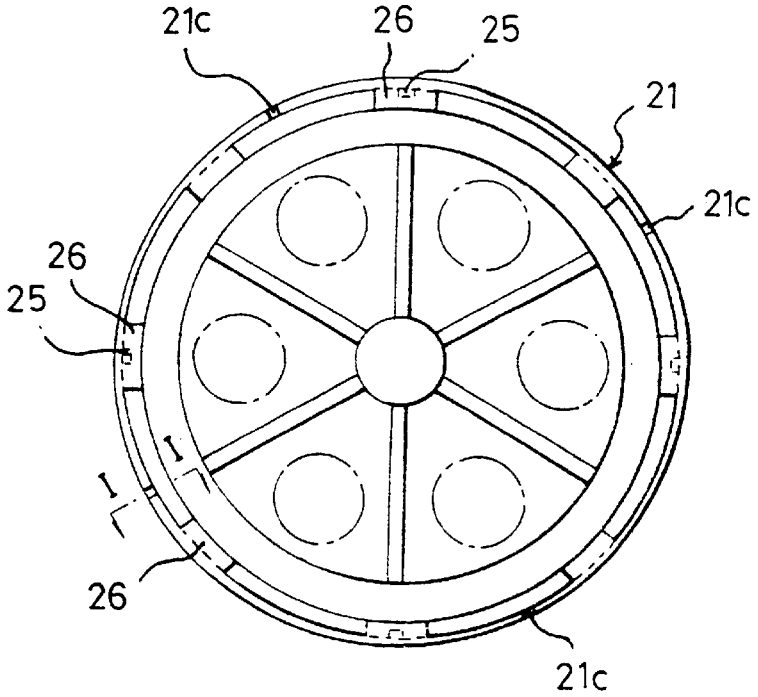
FIG. 7 illustrates a bottom view of a snubber base in accordance with a first embodiment of the present invention.
Figure 8:
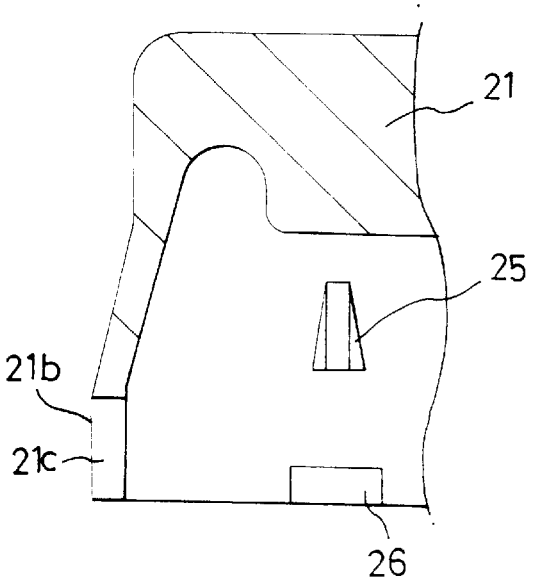
FIG. 8 illustrates a section across line I—I in FIG. 7.

A preferred embodiment of the present invention will be explained with reference to FIGS. 6~8.

There is snubber base spring coupling means provided on the inside surface of the snubber base 21 applicable to the preferred embodiment of the present invention, having upper and lower projections 25 and 26 for preventing a snubber base spring 24 from falling out of the snubber base. A detailed configuration of the snubber base spring coupling means having upper and lower projections 25 and 26 is as follows.

There are a plurality of lower projections 26 formed on an inside surface of the snubber base 21 at fixed intervals to support lower portions of the snubber base spring 24 for preventing the snubber base spring from falling out of the snubber base 21, and a plurality of upper projections 25 formed at an upper portion of the snubber base 21 to support an upper portion of the snubber base spring 24 for preventing the snubber base spring from being moved to an upper portion of the snubber base. The upper, and lower projections 25 and 26 may be formed to be aligned vertically on the inside surface of the snubber base 21 as shown in FIG. 7 for inserting the snubber base spring 24 therebetween, or to straddle on the other for inserting the snubber base spring 24. However, the upper, and lower projections 25 and 26 are not restricted to the aforementioned individual configuration because objects of the present invention can be achieved even if the upper, and lower projections 25 and 26 are not formed individually. Namely, each of the upper, and lower projections 25 and 26 may be formed as a single unit. However, this configuration of the upper, and lower projections 25 and 26 may cause problems in that it may not be favorable in view of mass production because processing of an undercut portion with injection molding is difficult. Furthermore, fitting or taking out the snubber base spring 24 in or from the upper, and lower projections 25 and 26 is cumbersome. Of the plurality of upper and lower projections 25 and 26 formed on inside surface of the snubber base 21, the upper projections 25 may be formed vertical and the lower projections 26 may be formed vertically below the upper projections 25 to reinforce the strength of the outside circumference of the snubber base, i.e., the sliding surface.

A thickness t of the sliding surface 21*b* at a portion between the upper and lower projections 25 and 26 is set to be in a range of 0.1~0.7 mm because if the thickness t of the sliding surface 21*b* is set less than 0.1 mm, the thickness is too thin to have a good injection moldability and will result in many defects. If the thickness t of the sliding surface 21*b* is set greater than 0.7 mm, the thickness may be too thick to permit the outside surface of the snubber base 21 to make the appropriately close contact with the inside surface of the damper cap 20 because even if the snubber base spring 24 is inserted between the upper and lower projections 25 and 26 to expand the snubber base 21, sliding surface 21*b* may not be expanded by the elastic force of the snubber base spring 24 as intended because of thicknes of the sliding surface. The thickness t of the sliding surface 21*b* may most preferably be in a range of 0.3~0.5 mm to have the best injection moldability of the snubber base 21 and also permit the snubber base 21 to be expand by the elastic force of the snubber base spring 24 and thereby make a close contact with the inside circumference of the damper cap 20.

And, a plurality of cut-away portions 21*c* are formed on the outside circumference of the snubber base 21 to be in communication with a inside space thereof for a satisfactory expansion of the sliding surface 21*b* by the elastic force of the snubber base spring 24 inserted between the upper and lower projections 25 and 26. Though it is not necessary to restrict the cutting direction of the cut-away portions 21*c*, considering formability, it is preferable to cut them in an axis direction (vertical direction on the drawing) as shown in FIG. 6. And, a size of the cut-away portion 21*c*, i.e., a length L from bottom of the snubber base 21 to an upper end of the cut-away portion 21*c*, is set such that the upper end of the cut-away portion 21*c* is positioned above a center of a section of the snubber base spring 24 inserted between the upper and lower projections 25 and 26. This positioning provides a satisfactory expansion of the sliding surface 21*b* by the elastic force of the snubber base spring 24 inserted between the upper and lower projections 25 and 26 so that the sliding surface can make a close contact with the inside circumference of damper cap 20. If the length L from bottom of the snubber base 21 to the upper end of the cut-away portion 21*c* is formed short so that the center of the snubber base spring 24 inserted between the upper and lower projections 25 and 26 is positioned above the upper end of the cut-away portion 21*c*, there will not be any satisfactory expansion of the snubber base 21 even if the elastic force of the snubber base spring 24 acts thereon. This will result in less than desirable contact between the inside circumference of the damper cap 20 and the outside circumference of the snubber base 21. Consequently, the solid state friction damping produced by the sliding friction between the inside surface of the damper cap 20 and the outside surface of the snubber base 21 as well as the air compression damping by the air inside damper cap 20, may be insufficient.

Figure 9:
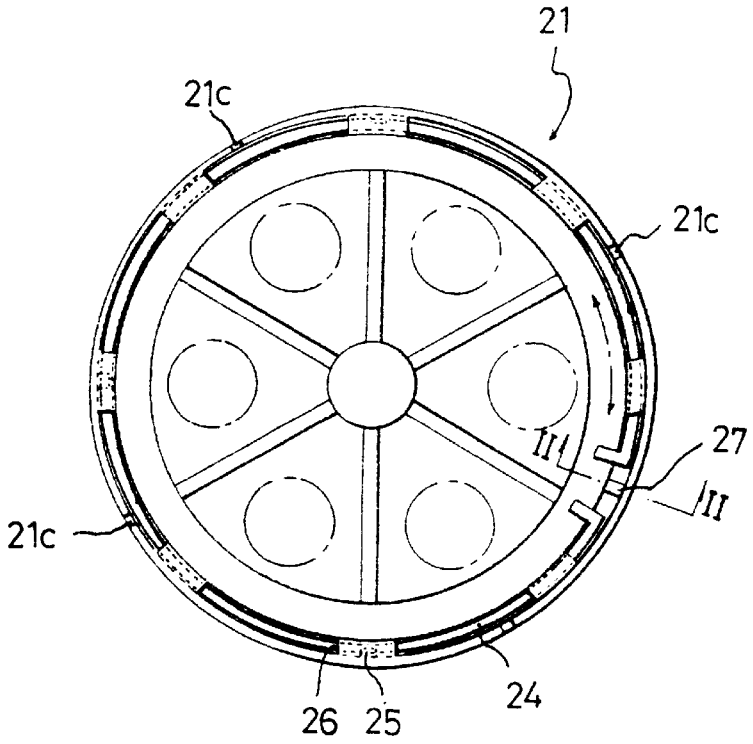
FIG. 9 illustrates a bottom view of a snubber base in accordance with a second embodiment of the present invention.
Figure 10:
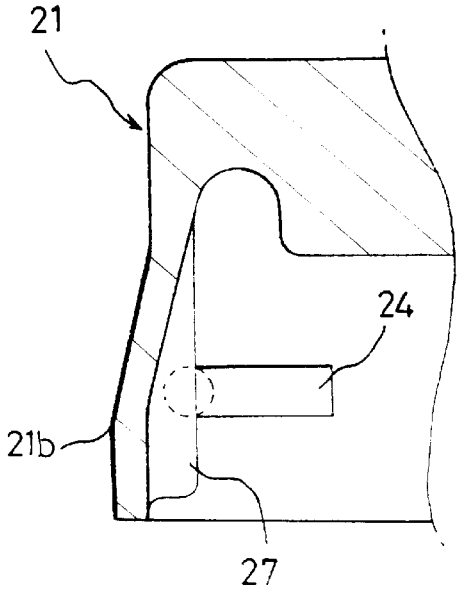
FIG. 10 illustrates a section across line II—II in FIG. 9.

Other embodiment of the present invention will be explained with reference to FIGS. 9 and 10.

Another embodiment of the damper assembly of the present invention further includes a stopper means 27 for preventing rotation of the snubber base spring 24 that may occur during the up and down movements of the snubber base. The stopper means 27 is in addition to the first embodiment of snubber base 21 of the present invention explained above. As shown in FIGS. 9 and 10, although the stopper means 27 is illustrated as a rib formed on the inside surface of the snubber base 21 in an axis direction (a vertical direction on the drawings) as a single unit with the snubber base 21, the configuration of the stopper means 17 is not restricted to this particular configuration only because a separate stopper means may be attached on the inside surface of the snubber base 21 to obtain the desired effect of preventing rotation of the snubber base spring 24 during the up and down movements of the snubber base 21 within the damper cap 20. The rib, illustrated as stopper means 27, is preferably formed a certain distance from the cut-away portion 21*c* in the outside surface of the snubber base 21 to prevent distortions. If stopper means 27 is placed such that both ends of the snubber base spring 24 are positioned close to any one of the cut-away portions 21*c* in the elastic force of the snubber base spring may distort snubber base 21, there is a possibility that the snubber base 21 is distorted into an ellipse as shown in dotted line in FIG. 9. That is, since the snubber base spring 24 inserted between the upper and lower projections 25 and 26 with a compression force has the greatest expansion force at both ends thereof having inwardly bents, if one of the cut-away portions 21*c* exists close to both ends, the snubber base 21 may be distorted into an ellipse. Therefore, if there are a plurality of cut-away portions 21*c* as shown in FIG. 9, the stopper means 27 should be formed substantially in the middle of the adjacent cut-away portions 21*c* for preventing the sliding surface 21*b* from being deformed excessively. The stopper means 27, formed in the axis direction in a form of a rib as a unit therewith, also serves to reinforce the snubber base 21.

Figure 11:
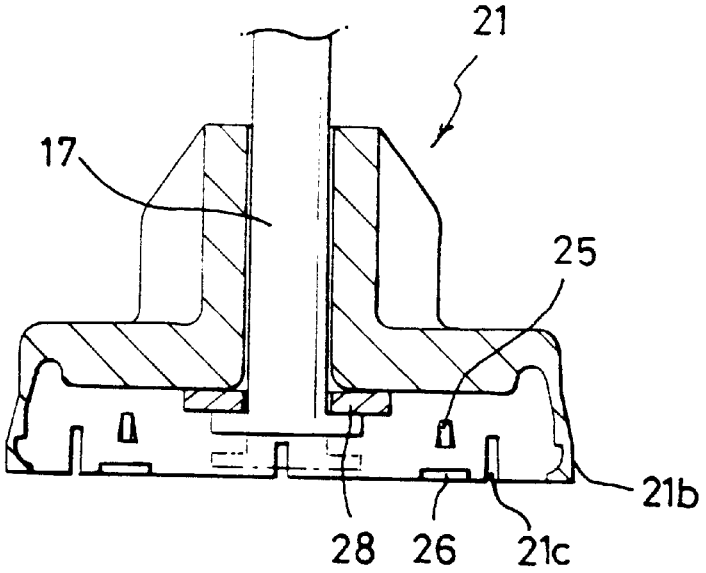
FIG. 11 illustrates a cross sectional view of a snubber base in accordance with a third embodiment of the present invention; and, FIG. 12 illustrates a cross sectional view of a snubber base in accordance with a fourth embodiment of the present invention.
Figure 12:
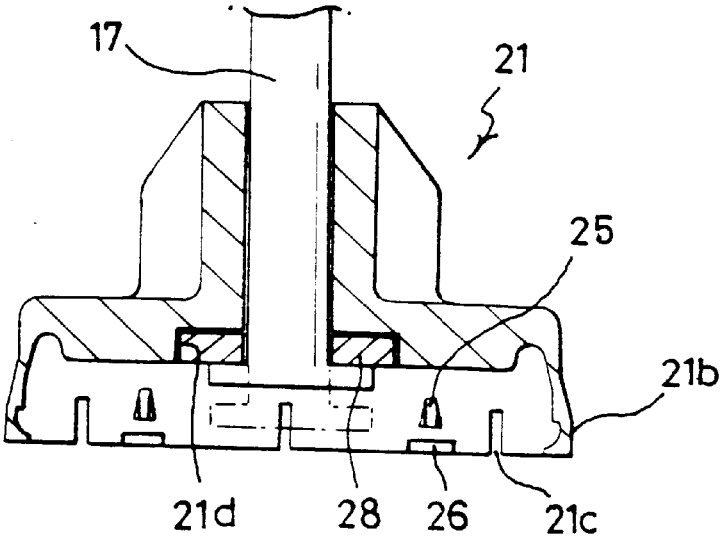

Another embodiment of the damper assembly of the present invention will be explained with reference to FIGS. 11 and 12.

This other embodiment of the damper assembly is devised such that the lower end of the snubber bar 17 does not impact at the bottom of the snubber base 21 even if the restoring force of the damping spring 22, which acts as a spring damper, is reduced do to the prolonged use of the washing machine. That is, even if the restoring force of the damping spring 22 is reduced until it is incapable of pushing the snubber base 21 down at rise of the damper cap 20, leading the lower end of the snubber bar 17 to extend beyond the bottom of the snubber base 21 as shown in FIGS. 11 and 12, this embodiment of the damper assembly is devised to prevent the lower end that extends beyond the bottom of the snubber base 21 from impacting the bottom of the snubber base 21 before damper cap 20 moves down. In order to achieve this result, a washer 28 is provided at a bottom of the snubber base 21 occurs. The washer 28 is formed of a sound absorbing material that can absorb the impact that when the lower end of the snubber bar 17 hits the bottom of the snubber base 21 because of the degradation of the restoring force of the damper spring 22. The washer can be made of any material if it can absorb the impact the and noise caused of impact by the snubber bar. However, it is preferable to use a rubber, sponge or textile because of production cost and commercial availability. Washer 28 fitted on bottom of snubber base 21 may be fixed directly, and after to the bottom of the snubber base 21 as shown in FIG. 11, or it may be fixed in a recess 21*d* formed in the bottom of the snubber base 21 as shown in FIG. 12. However, in the case when the washer 28 is accommodated in the recess 21*d*, to obtain satisfactory impact absorption the washer 28 should be fitted such that the washer 28 is extended beyond the bottom of the snubber base 21 or occupies an area wider than an area of the lower end of the snubber bar 17. Various joining means, such as press fit, bonding, thread joining, and hooking are applicable in fitting washer 28 to the bottom of the snubber base 21.

The damper assembly of the present invention as has been explained has the following advantages.

First, even if a tension spring 24*b* is used as the snubber base spring 24, the solid state firction damping produced form the sliding friction can be maintained because of the close contact between the outside circumference of the snubber base and the inside circumference of the damper cap. The close contact results from stopper means 27 preventing the snubber base spring from rotating along the recess 21*a* and falling out during the up and down movement of snubber base 21 within damper dap 20. since the Second, even if there is a temperature rise in damper cap 20 and snubber base 21 due to the repeated friction between them, because the upper and lower projections 25 and 26 formed on the inside surface of the sliding surface 21*b* prevent the distortion of the snubber base 21, there will be close contact between the outside circumference of the snubber base 21 and the inside circumference of the damper cap 20 resulting in continued absorption of vibration by means of friction and air compression/expansion furthermore, even if the rubber outside circumference of snubber base 21 and the inside circumference of damper cap 20 rub together creating friction because fluororesin coating applied on the sliding surface 21*b* is worn down from repeated friction, snubber base 21 will not be turned inside out because the upper and lower projections 25 and 26 formed on the inside surface of the sliding surface 21*b* can sustain their strength.

Third, even if snubber base 21 comes out of damper cap 20 through the bottom opening of damper cap 20 due to a severe vibration, the snubber base spring can be kept in postion by the strong support of the upper and lower projections 25 and 26.

Fourth, even if the lower end of the snubber bar 17, is extended beyond bottom of the snubber base 21 due to the inability to push snubber base 21 down of during an upward movement of the damper cap 20 and impact the bottom of the snubber base 21 when the damper cap 20 moves down again, no impact will be given to the snubber base because washer 28 is formed of a sound absorbing material fitted at an underside of the snubber base 21. This prevents breakage of the snubber base as well as generation of noise.

Fifth, the close contact between sliding surface 21*b* and the inside circumference of damper cap 20, permitted by the satisfactory expansion of the sliding surface 21*b* due to the formation of the cut-away portions 21*c* in the snubber base 21, improves a damping effect.

It will be apparent to those skilled in the art that various modifications and variations can be made in the damper assembly in a washing machine of the present invention without departing from the spirit or scope of the invention. Thus, it is intended that the present invention cover the modifications and variations of this invention provided they come within the scope of the appended claims and their equivalents.

What is claimed is:

1. A damper assembly comprising a snubber bar having an upper portion supported at a corner of a washing machine body, the damper assembly comprising:

a damper cap coupled to an outside surface of an outside tub for supporting a lower portion of the snubber bar, a snubber base held at a lower end of the snubber bar and elastically inserted inside the damper cap, a damping spring accommodated in the damper cap, inserted in the snubber bar, and retained by the snubber base, such that compression and extension of the damping spring due to motion of the damper cap relative to the snubber base produces spring damping, and a snubber base spring inserted in an inside circumference of the snubber base for expanding the snubber base so that an outside circumference of the snubber base makes close contact with the inside circumference of the damper cap;

wherein at least one cut-away portion is formed in a circumferential surface of a snubber base for uniform distribution of an elastic force of the corresponding snubber base spring so that the close contact of the snubber base with the inside circumference of the damper cap can be improved, and wherein the snubber base is constructed as a single piece such that the snubber base has a substantially continuous upper surface to produce air damping between the snubber base and the damper cap.

2. A damper assembly as claimed in claim 1, further comprising spring holding means formed on the inside circumference of the snubber base for keeping the snubber base spring in position.

3. A damper assembly as claimed in claim 2, wherein the spring holding means, formed on an inside circumference of the snubber base for keeping the snubber base spring in position, includes a plurality of upper projections and lower projections.

4. A damper assembly as claimed in claim 3, wherein each of the upper projections is formed in a vertical direction and each of the lower projections is formed in a horizontal direction, for reinforcing a strength of the snubber base.

5. A damper assembly as claimed in claim 3, wherein the upper projections and the lower projections are aligned vertical to the others.

6. A damper assembly as claimed in claim 1 or 2, wherein a length of the cut-away portion from a lower end of the snubber base to an upper end of the cut-away portion is set such that the upper end of the cut-away portion is positioned above a center of a section of the snubber base spring inserted between the upper, and lower projections.

7. A damper assembly as claimed in claim 1, wherein a sliding surface of the snubber base has a thickness in a range from 0.1 mm to 0.7 mm.

8. A damper assembly as claimed in claim 7, wherein the sliding surface of the snubber base has a thickness in a range from 0.3 mm to 0.5 mm.

9. A damper assembly as claimed in claim 1, further comprising stopper means formed on the inside surface of the snubber base for preventing rotation of the snubber base spring.

10. A damper assembly as claimed in claim 9, wherein the stopper means is a rib formed on the inside surface of the snubber base as a single unit with the snubber base.

11. A damper assembly as claimed in claim 10, wherein the rib is formed vertical on the inside surface of the snubber base.

12. A damper assembly as claimed in any one of the claims of 9–11, wherein the snubber base spring, fitted inside of the snubber base, held by the spring holding means and prevented from being rotated by the stopper means, substantially has a circular form and one portion opened with both ends thereof bent inwardly.

13. A damper assembly as claimed in claim 9 or 10, wherein the stopper means is formed at a certain distance away from the cut-away portion formed in the outside surface of the snubber base for preventing an excessive deformation of the sliding surface of the snubber base.

14. A damper assembly as claimed in claim 13, wherein the snubber base spring, fitted inside of the snubber base, held by the spring holding means and prevented from being rotated by the stopper means, substantially has a circular form and one portion opened with both ends thereof bent inwardly.

15. A damper assembly as claimed in claim 1, wherein a washer formed of a sound absorbing material is provided at the underside of the snubber base for making contact with the lower end of the snubber bar.

16. A damper assembly as claimed in claim 15, wherein the sound absorbing material is either a rubber, sponge or textile.

17. The damper assembly of claim 1, wherein the damper cap and the snubber base are sized and positioned so that contact of an inside surface of the damper cap with an outside surface of the snubber base produces friction damping.

18. The damper assembly of claim 1, wherein the snubber base and the damper cap are sized and positioned to produce the air damping.

19. A damper assembly comprising a plurality of snubber bars each having:

an upper portion supported at a corner of a washing machine body, a damper cap coupled to an outside surface of an outside tub for supporting a lower portion of the snubber bar, a snubber base held at a lower end of the snubber bar and elastically inserted inside the damper cap by a damping spring for making up and down movements while making close contact with an inside circumference of the damper cap, a snubber base spring inserted in an inside circumference of the snubber base for expanding the snubber base so that an outside circumference of the snubber base makes close contact with the inside circumference of the damper cap, and a stopper means formed on an inside surface of the snubber base for preventing rotation of the snubber base spring;

wherein at least one cut-away portion is formed in a circumferential surface of a snubber base for uniform distribution of an elastic force of the corresponding snubber base spring so that the close contact of the snubber base with the inside circumference of the damper cap can be improved.

20. A damper assembly comprising a plurality of snubber bars each having:

an upper portion supported at a corner of a washing machine body, a damper cap coupled to an outside surface of an outside tub for supporting a lower portion of the snubber bar, a snubber base held at a lower end of the snubber bar and elastically inserted inside the damper cap by a damping spring for making up and down movements while making close contact with an inside circumference of the damper cap, and a snubber base spring inserted in an inside circumference of the snubber base for expanding the snubber base so that an outside circumference of the snubber base makes close contact with the inside circumference of the damper cap;

wherein at least one cut-away portion is formed in a circumferential surface of a snubber base for uniform distribution of an elastic force of the corresponding snubber base spring so that the close contact of the snubber base with the inside circumference of the damper cap can be improved, and wherein a washer formed of a sound absorbing material is provided at the underside of the snubber base for making contact with the lower end of the snubber bar.

* * * * *